United States Patent [19]

Irwin

[11] Patent Number: 4,881,841

[45] Date of Patent: Nov. 21, 1989

[54] HAND STAMPING DEVICE OR WRITING IMPLEMENT

[76] Inventor: Lawrence F. Irwin, 12860 San Fernando Rd., Sylmar, Calif. 91342

[21] Appl. No.: 242,553

[22] Filed: Sep. 12, 1988

[51] Int. Cl.[4] ..... B43K 29/00

[52] U.S. Cl. ..... 401/195; 101/333; 101/379; 101/406

[58] Field of Search ..... 401/195; 101/405, 406, 101/3 R, 368, 379, 371, 333

[56] References Cited

U.S. PATENT DOCUMENTS

| | | | |
|---|---|---|---|
| 743,762 | 11/1903 | Shea | 101/368 |
| 1,509,876 | 9/1924 | Ricerra | 101/3 R |
| 2,627,227 | 2/1953 | Claggett et al. | 101/333 |
| 3,618,518 | 11/1971 | Rigoni | 401/195 X |
| 4,277,195 | 7/1981 | Huslik | 401/195 |
| 4,676,162 | 6/1987 | Phipps, Sr. et al. | 101/405 |

FOREIGN PATENT DOCUMENTS

| | | | |
|---|---|---|---|
| 2110600 | 6/1983 | United Kingdom | 401/195 |

*Primary Examiner*—Steven A. Bratlie
*Attorney, Agent, or Firm*—James E. Brunton

[57] ABSTRACT

A combination hand stamp and writing instrument which has the appearance of a ball point pen of standard size and construction. The apparatus includes an easy to use indicia imprinting assembly which is conveniently housed within the upper portion of the device. The indicia imprinting assembly is movable from a retracted position into a stamping position against the urging of a novel biasing mechanism in a manner that prevents smearing and produces a clean, sharp inprint.

13 Claims, 2 Drawing Sheets

2
3
A
12
14
14a
14b
16
16a
16b
18
20
22
22a
22b
24
25
25a
26
28
30
30a
31
34
34a
34b
36
37
39
40
M
M1
E
E1
C

HAND STAMPING DEVICE OR WRITING IMPLEMENT

BACKGROUND OF THE INVENTION

1. Field of the Invention

The present invention relates generally to hand stamping apparatus. More particularly, the invention relates to a novel combination hand stamping device and writing instrument.

2. Discussion of the Prior Art

In the past, a wide variety of portable hand stamps have been suggested. These stamps, which may comprise the user's name, address, telephone number, or the like, are useful for imprinting indicia upon letters, envelopes, checks and the like. So that the devices are easily portable and can be used at remote locations, prior art hand stamps have frequently been provided in kit form with the kits including, along with the stamp, a small ink pad for inking the stamp and a compact housing for carrying the stamp and the pad.

Although some attempts have been made in the past to combine a pen or pencil with a stamp, such attempts have generally proved unsuccessful. Frequently, such devices have been so complicated and elaborate as to defy manufacture at reasonable cost. Other such devices have proven unreliable and inconvenient in use. In particular, many prior art devices have poorly designed imprinting mechanisms so that the imprint tends to be smeared, rather than clean and sharp.

The apparatus of the present invention uniquely overcomes the drawbacks of the prior art combination hand stamping and writing instrument devices by providing a compact, simple, reliable and inexpensive unit. In its simplest form, the device of the invention comprises a spring biased imprinting mechanism which is housed in the upper portion of the device and a cooperating lower portion which houses the writing instrument. The stamping apparatus includes a combination rechargeable ink pad and indicia carrying element which is movable against the resistance of the biasing mechanism from a first at rest position into a second imprinting position. The spring biasing mechanism is a novel design so as to make possible clear, sharp imprints by the indicia carrying element.

SUMMARY OF THE INVENTION

It is an object of the present invention to provide a combination hand stamp and writing instrument which has the appearance of a ball point pen of standard size and construction. However, the device includes an easy to use, indicia imprinting assembly which is conveniently housed within the upper portion of the device.

It is another object of the invention to provide an apparatus of the aforementioned character in which the indicia imprinting assembly is movable from a retracted position into a stamping position against the urging of a novel biasing mechanism in a manner that prevents smearing and produces a clean, sharp imprint.

It is another object of the invention to provide an apparatus of the character described in which the indicia imprinting element of the device is continuously maintained in pressural engagement with a rechargeable ink pad encapsulated within a removable cap provided at the upper portion of the device.

It is another object of the invention to provide an apparatus as described in the preceding paragraphs in which the writing instrument includes a writing point which is retractable when not in use.

It is a further object of the invention to provide an apparatus of the aforementioned character which is attractive, lightweight, easy to use, and readily transportable.

It is yet another object of the invention to provide a combination writing instrument and self inking hand stamp as described in the preceding paragraphs which includes a minimum number of moving parts and is easy and inexpensive to manufacture in large volume.

DESCRIPTION OF THE INVENTION

Figures 1, 2, 3, 4:
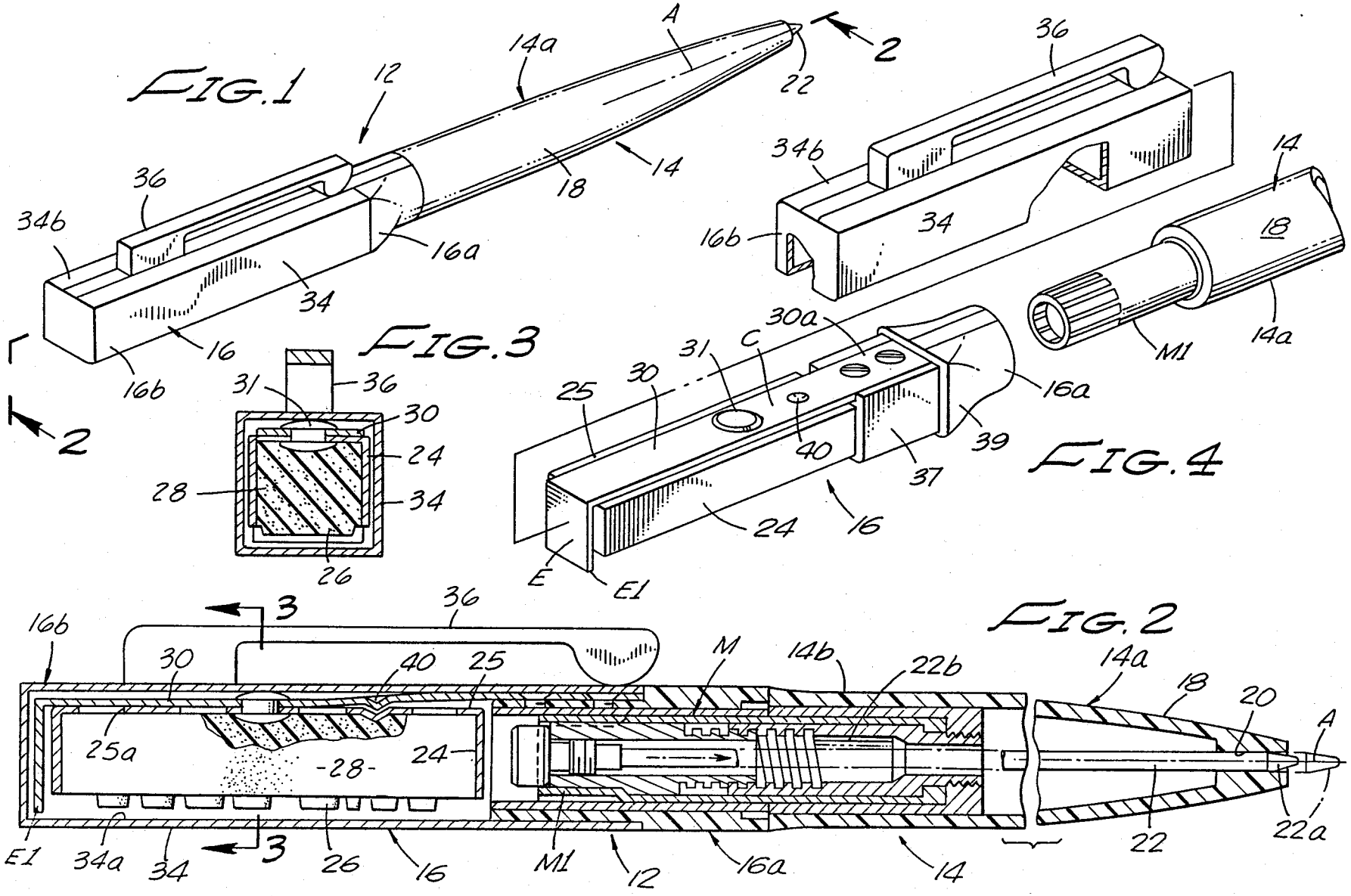
FIG. 1 is a generally perspective view of the combination writing instrument and stamp of the present invention.
FIG. 2 is a cross-sectional view taken along Lines 2—2 of FIG. 1.
FIG. 3 is a cross-sectional view taken along Lines 3—3 of FIG. 2.
FIG. 4 is an exploded generally perspective view illustrating the manner of disassembly of the device.

Referring to the drawings, and particularly to FIGS. 1 through 4, the combination writing instrument and stamp apparatus comprises a housing 12 made up of first and second cooperatively associated assemblages, generally designated by the numerals 14 and 16. As best seen in FIG. 2, first assemblage 14 includes a lower, or forward, portion **14*a* having a longitudinally extending axis "A". The forward portion comprises a hollow casing 18 having longitudinally extending bore 20 therethrough. A writing element 22, shown here as a ball point pen element, is carried by casing 18 and the tip 22*a* thereof is adapted for limited reciprocal movement within bore 20 whereby the writing tip is extendible from and retractable into bore 22 in the manner illustrated by the solid and phantom lines of FIG. 2**.

As shown in FIG. 1, the first or lower assemblage 14 is generally cylindrical in shape and has the appearance of the lower portion of a ball point pen of standard construction. Partially housed within the rearward portion **14*b* of the first assemblage 14 is a mechanism "M" for extending and retracting the tip 22*a* of writing element 22**. Mechanism "M" is of a standard construction the character of which will be described in greater detail hereinafter.

Second, or upper, assemblage 16, which includes a forward portion **16*a* and a rearward portion 16*b*, carries a stamp means for making an imprint on a planar surface. In the present form of the invention, the stamp means comprises a supporting structure 24 (FIG. 2**)

which carries cooperating imprinting indicia 26 and a stamp, or ink absorbing, pad 28 constructed of an absorbent material such as felt or the like to transfer ink to imprinting indicia 26.

Figure 5:
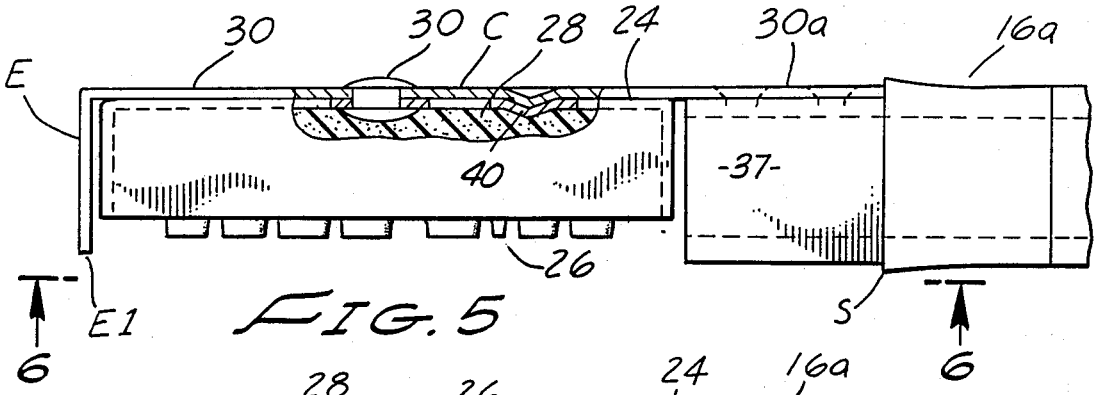
FIG. 5 is a fragmentary side-elevational view partly in cross-section of the stamp portion of the device.
Figure 6:
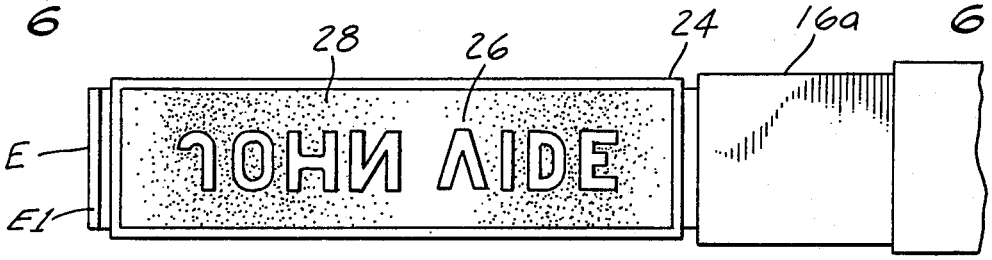
FIG. 6 is a fragmentary view taken along Lines 6—6 of FIG. 5.
Figure 7:
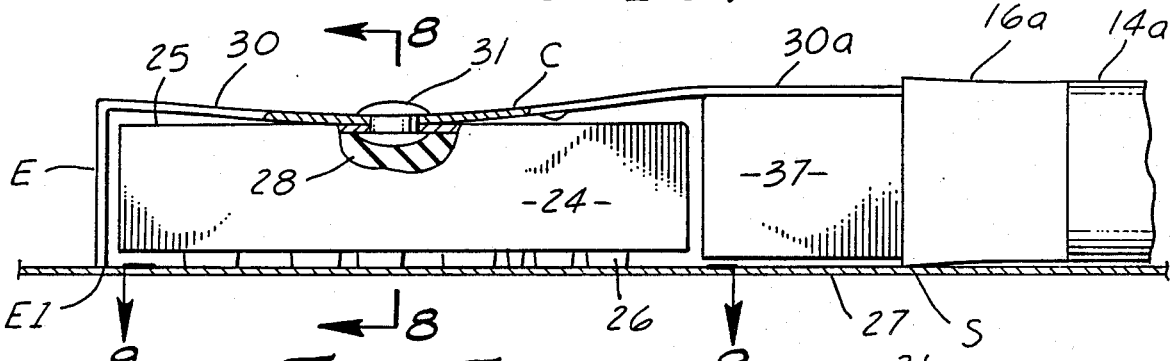
FIG. 7 is a fragmentary side-elevational view partly in cross-section of the stamp portion of the device illustrating movement of the stamp into contact with a planar surface.
Figure 8:
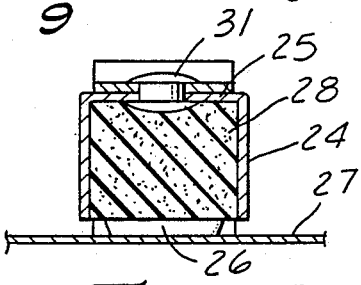
FIG. 8 is a cross-sectional view taken along Lines 8—8 of FIG. 7.

A highly important feature of the apparatus of the present invention is illustrated in FIGS. 5 and 7. As thereshown, the imprinting indicia of the device is movable from a first, at rest position, as shown in FIG. 5, to a second, imprinting position as shown in FIG. 7, wherein the printing indicia is brought in to uniform pressural engagement with a planar surface such as that presented by a member such as a sheet of paper 27 (FIG. 7). It is important to note that when the imprinting indicia is in the at rest position shown in FIG. 5 it is disposed within a second plane which is generally parallel to the first plane A, that is, the plane of the axis of housing 12. When the imprinting indicia is moved into its imprinting position, as shown in FIG. 7, the imprinting indicia 26 moves into a third plane which is substantially parallel to the aforementioned first and second planes.

Also forming an important feature of the stamp means of the present invention is biasing means for yieldably resisting movement of the imprinting indicia 26 between the first and second positions. It is the unique action of this biasing means, coupled with the novel design of the imprinting indicia and its cooperatively associated ink pad, that enables sharp, clear imprints to be repeatably made on various planar surfaces using the apparatus of the invention.

In the embodiment of the invention shown in the drawings the biasing means comprises an elongated spring member 30 to which the previously identified supporting structure 24 is pivotally interconnected by means of a connector, such as rivet 31. As best seen by referring to FIG. 5, spring member 30 is affixed proximate end **30*a* thereof to portion 16*a* of second assemblage 16 and includes a generally planar shaped, yieldably deformable central section C. Importantly, spring member 30 also includes a perpendicularly extending end wall "E" located at the end opposite end 30*a*. It is to be observed that the edge "El" of end wall "E" is disposed within the previously identified third plane, that is, the plane in which the imprinting indicia reside when disposed in their second, imprinting position as shown in FIG. 7**.

Referring particularly to FIG. 5, when the spring 30 is in an at-rest configuration, the central section C is disposed within a fourth plane, which is generally parallel to the previously identified first, second and third planes. For reasons presently to be discussed, the forward portion **16*a* of the second assemblage 16 is provided with a surface "S" (FIG. 7**) which is disposed within a sixth plane. It is to be observed that this sixth plane is only slightly spaced apart from the third plane within which edge El of the spring member is disposed.

With the construction described in the preceding paragraphs, when the apparatus is not in use the printing indicia 26 are maintained in the elevated, at rest position shown in FIG. 5. Referring particularly to FIGS. 1 and 2, it can be seen that a cap, or encapsulating cover 34, which forms a part of rear assemblage 16, is receivable over the stamp means. The open end of cover 34 is closely receivable over the forward portion **16*a* of the second assemblage 16, which portion is generally rectangular in cross-section. The fit of the cap is sufficiently close so that friction will hold the cap in place over portion 16*a*. As indicated in FIG. 2, with cover 34 in the stamp means encapsulating position, the indicia 26 are spaced from the inside surface 34*a* of cover 34 so as to preclude smearing of the cover with ink. A clip 36 is affixed to the upper surface 34*b*** of the cover so that the device can be conveniently clipped to the pocket of a coat or shirt.

Turning to FIG. 4, the forward portion **16*a* of the second assemblage includes a hollow, block-shaped portion 37 over which cover 34 is slidably received and an inwardly tapering hollow connector portion 39 which closely receives the rearward, cylindrically shaped portion Ml of mechanism M. In this way assemblages 14 and 16 are operably connected in the manner shown in FIG. 2. Portion Ml is knurled so that upon rotation of assemblage 14 relative to assemblage 16, tip 22 will be caused to extend and retract in the manner indicated in FIG. 2. This extension and retraction of tip 22 results upon relative rotation of assemblages 14 and 16 due to the threaded relationship between portion 22*b* (FIG. 2) of writing element 22 and portion Ml of mechanism M. The design of mechanism M is of a character well known to those skilled in the art and, because the details of the mechanism form no part of the present invention, further discussion thereof is deemed unnecessary. Suffice to say that mechanism M can have the construction shown in FIG. 2, or similar, well known mechanisms can be carried within assemblage 14 to accomplish the desired extension and retraction of tip 22*a*. Alternatively, the writing element can be fixedly mounted within assemblage 14**.

Figure 9:
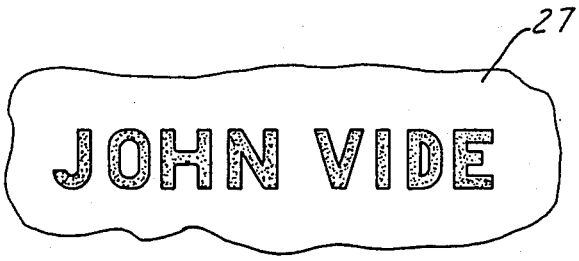
FIG. 9 is a view taken along Lines 9—9 of FIG. 7.

In using the apparatus of the invention to imprint indicia on a flat surface, cap, or cover 34 is removed to expose the stamp means as shown illustrated in FIG. 5. The device is then firmly placed on the surface to be imprinted, such as the upper surface of planar member 27 (FIG. 7). It is to be noted that prior to the printing step, edge El of spring 30 firmly engages member 27 proximate one end of the imprinting indicia 26 and surface S of portion **16*a* firmly engages member 27 proximate the other end of the imprinting indicia. Upon exerting a downward force proximate the center of spring member 30, the central portion C thereof will be moved out of the previously identified fourth plane into the generally convex configuration shown in FIG. 7. This action moves the imprinting indicia clearly and positively into pressural engagement with the surface of member 27 so that a sharp imprint of the type shown in FIG. 9 results. Because surfaces El and S are at all times in firm contact with the surface of member 27, no slipping or smearing of the imprinting indicia will result. When the downward pressure on the spring member 30 is released, the spring automatically returns to the position shown in FIG. 5, cleanly separating the imprinting indicia from the surface of member 27**. Without this novel action of the biasing means, undesirable smearing of the imprint would likely result.

Figure 10:
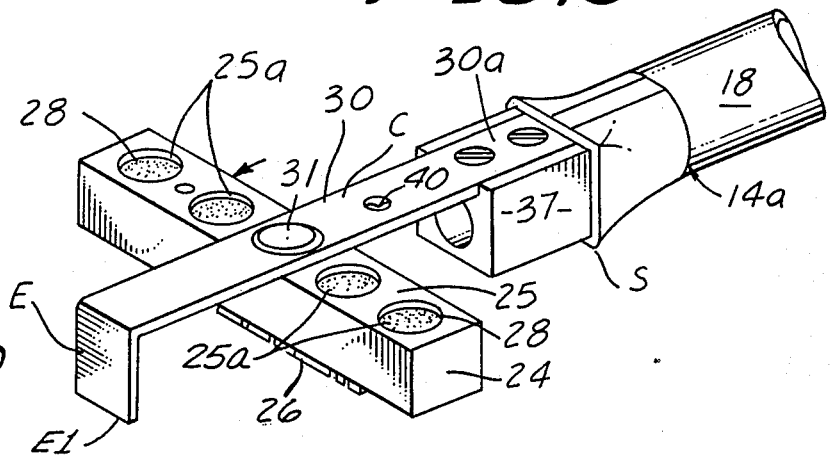
FIG. 10 is a fragmentary generally perspective view of the stamp portion of the device as seen in an ink pad filling orientation.

Another unique feature of the apparatus of the invention is shown in FIG. 10. As there indicated, supporting structure 24 is rotatable relative to spring 30 about connector 31 from a position of alignment with the spring member as shown in FIG. 4 to an angular orientation with respect thereto as shown in FIG. 10. As illustrated in FIG. 10, supporting structure 24 includes a top plate 25 having a plurality of spaced apertures **25*a*. Apertures 25*a* permit ink pad 28 to be recharged with ink should it dry out and fail to properly provide sufficient amounts of ink to the imprinting indicia 26 which are in contact with pad 28. To hold structure 24 normally in alignment with spring 30, a detent 40, of the character shown in FIGS. 2 and 10**, is provided.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without department from the scope and spirit of the invention, as set forth in the following claims.

I claim:

1. A combination writing instrument and stamp, comprising:

(a) a housing having a longitudinal axis disposed in a first plane;

(b) a writing element carried by said housing; and (c) a stamp means carried by said housing for making an ink imprint on a surface, said stamp means comprising:

(1) a supporting structure;

(2) imprinting indicia carried by said supporting structure and disposed in a second plane substantially parallel to said first plane, said imprinting indicia being movable from a first at rest position to a second imprinting position wherein said imprinting indicia are disposed in a third plane substantially parallel to said first and second planes; and (3) biasing means for yieldably resisting movement of said imprinting indicia between said first and second positions.

2. A combination as defined in claim 1 in which, said biasing means comprises a spring member connected to said supporting structure and including a generally planar shaped, yieldably deformable section normally disposed in an at rest position within a fourth plane generally parallel to said third plane.

3. A combination as defined in claim 2 in which said housing includes a surface engaging side wall disposed within a plane parallel to, but slightly spaced from, said third plane and in which said spring member includes an end wall extending generally perpendicularly to said planar shaped section, said end wall terminating in a surface engaging edge disposed within said third plane.

4. A combination as defined in claim 3 in which said generally planar shaped section is yieldably deformable out of said fourth plane into a generally convex configuration to move said imprinting indicia into said second imprinting position.

5. A combination as defined in claim 4 in which an ink pad is carried within said supporting structure and in which said supporting structure is pivotally connected to said spring member for movement between a first position wherein said supporting structure is aligned with said planar shaped section and a second position wherein said supporting structure extends angularly with respect to said planar shaped section.

6. A combination as defined in claim 5 in which said stamp means includes an ink dispensing means carried within said supporting structure for dispensing ink to said imprinting indicia.

7. A combination as defined in claim 6 in which said supporting structure includes a top plate having apertures therethrough for adding ink to s id ink pad when said supporting structure is in said second position.

8. A combination writing instrument and stamp, comprising:

(a) a first assemblage, having a longitudinal axis disposed in a first plane and comprising:

(i) a casing having a longitudinally extending bore therethrough; and (ii) a writing element including a writing tip carried by said casing and adapted for reciprocal movement within said bore, whereby said writing tip is extendible from and retractable into said bore; and (b) a second assemblage operably interconnected with said first assemblage including:

(i) an ink pad;

(ii) imprinting indicia disposed in a plane substantially parallel to said first plane, said imprinting indicia being movable from a first at rest position to a second imprinting position; and (iii) biasing means for yieldably resisting movement of said imprinting indicia from said first position wherein said imprinting indicia is disposed in a second plane generally parallel to said first plane, to a second position wherein said imprinting indicia is disposed in a third plane generally parallel to said second plane.

9. A combination as defined in claim 8 in which said biasing means comprises a spring member having a planar section and a perpendicularly extending end wall portion, said end wall portion terminating in an edge disposed in said third plane.

10. A combination as defined in claim 9 in which said ink pad and said imprinting indicia are carried by a supporting structure, which structure is pivotally interconnected with said planar section of said spring member for swinging movement with respect thereto.

11. A combination writing instrument and stamp, comprising:

(a) a housing having a longitudinal axis disposed in a first plane;

(b) a writing element carried by said housing; and (c) a stamp means carried by said housing for making an ink imprint on a surface, said stamp means comprising:

(1) a supporting structure;

(2) imprinting indicia carried by said supporting structure and disposed in a second plane substantially parallel to said first plane, said imprinting indicia being movable from a first at rest position to a second imprinting position wherein said imprinting indicia are disposed in a third plane substantially parallel to said first and second planes; and (3) biasing means for yieldably resisting movement of said imprinting indicia between said first and second positions, said biasing means comprising a spring member connected to said supporting structure and including a generally planar shaped, yieldably deformable section normally disposed in an at rest position within a fourth plane generally parallel to said third plane, said planar shaped section being yieldably deformable out of said fourth plane into a generally convex configuration to move said imprinting indicia into said second imprinting position.

12. A combination as defined in claim 11 in which said housing includes a surface engaging side wall disposed within a plane parallel to, but slightly spaced from, said third plane and in which said spring member includes an end wall extending generally perpendicularly to said planar shaped section, said end wall terminating in a surface engaging edge disposed within said third plane.

13. A combination as defined in claim 12 in which an ink pad is carried within said supporting structure and in which said supporting structure is pivotally connected to said spring member for movement between a first position, wherein said supporting structure is aligned with said planar shaped section, and a second position wherein said supporting structure extends angularly with respect to said planar shaped section.

* * * * *